United States Patent [19]

Blomberg et al.

[11] 4,236,380

[45] Dec. 2, 1980

[54] CONTROL SYSTEM FOR AUTOMATIC DELAYED OPERATION OF A GAS OPERATED ABSORPTION REFRIGERATOR

[75] Inventors: Peter E. Blomberg, Stockholm; Magnus C. W. Lindmark, Stocksund, both of Sweden

[73] Assignee: Aktiebolaget Electrolux, Stockholm, Sweden

[21] Appl. No.: 48,666

[22] Filed: Jun. 14, 1979

[30] Foreign Application Priority Data

Jun. 14, 1978 [SE] Sweden ..... 7806849

[51] Int. Cl.[3] ..... F25B 15/00; F25B 27/00

[52] U.S. Cl. ..... 62/148; 62/236; 62/476; 62/239; 219/279

[58] Field of Search ..... 62/148, 236, 238 B, 62/239, 476; 219/279

[56] References Cited

U.S. PATENT DOCUMENTS

| | | | |
|---|---|---|---|
| Re. 25,782 | 5/1965 | Grubb | 62/236 |
| 3,105,363 | 10/1963 | von der Scher | 62/148 |
| 3,177,677 | 4/1965 | Boren et al. | 62/148 X |
| 3,225,560 | 12/1965 | Doebeli | 62/236 |
| 3,253,421 | 5/1966 | Grubb | 62/148 |
| 3,648,481 | 3/1972 | Ando et al. | 62/236 |
| 3,749,307 | 7/1973 | Odashima et al. | 62/148 X |
| 3,860,786 | 1/1975 | Wass | 62/236 X |
| 3,875,369 | 4/1975 | Sellerstam | 62/236 X |

*Primary Examiner*—Lloyd L. King
*Attorney, Agent, or Firm*—Alfred E. Miller

[57] ABSTRACT

An automatic control system for an absorption refrigerator in a vehicle, such as a recreational vehicle, which is connected to a motor-driven generator. The refrigerator is operated alternatively by either 110 A.C. voltage, 12 volt D.C. voltage, or by gas. If gas is only available, the refrigerator is automatically operated by that means, however, the ignition of the gas burner is prevented when the vehicle is stopped in a filling station and the generator ceases to operate. The arrangement has means which delays the closing of a circuit through a control system after another circuit, including a heating cartridge, has been interrupted.

5 Claims, 1 Drawing Figure

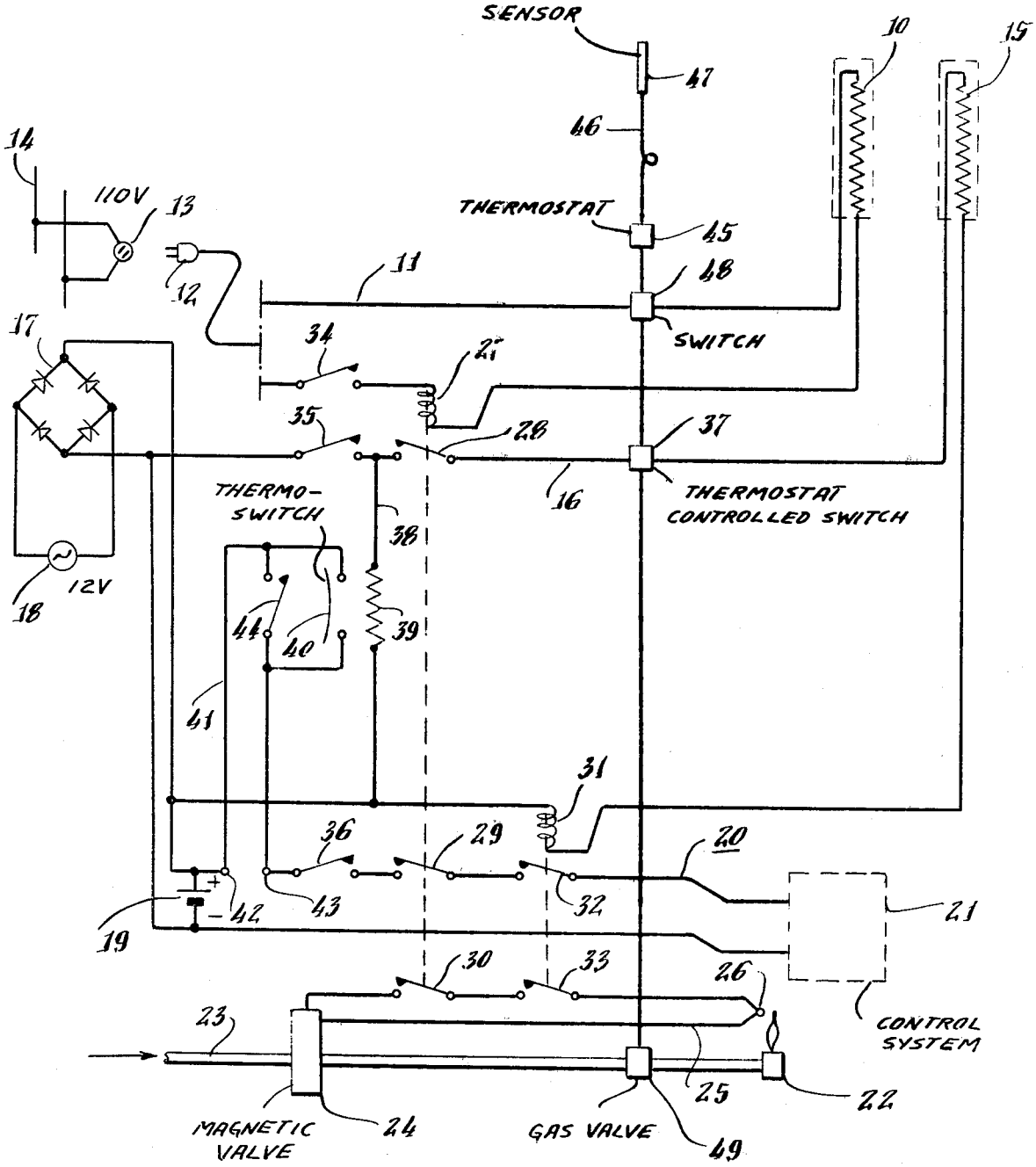
SENSOR
47
10
15
46
14
110V
13
THERMOSTAT
45
12
11
48
SWITCH
17
34
27
35
28
37
THERMO-
SWITCH
16
THERMOSTAT
CONTROLLED SWITCH
38
12V
18
44
40
39
41
31
36
29
20
42
43
32
21
19
30
33
26
23
CONTROL
SYSTEM
25
22
MAGNETIC
VALVE
24
GAS VALVE
49

CONTROL SYSTEM FOR AUTOMATIC DELAYED OPERATION OF A GAS OPERATED ABSORPTION REFRIGERATOR

In a trailer or motor home having a refrigerator with an absorption refrigerating apparatus having alternately operated heat sources, the refrigerating apparatus is operated by electric heat when the vehicle engine is operating. The apparatus is provided with an electric heating cartridge which is operated by the 12 volts from the car generator. When the trailer or motor home is moved into a filling station and the vehicle engine is switched off, the control system enters into operation and lights a gas flame in the burner to cause operation to continue by the use of gas. However, on such occasions, it is desired to avoid or delay lighting of the gas until the vehicle has left the filling station. This problem can be solved in accordance with the invention by means of a delayed closing of the circuit through the control system when the circuit through the heating cartridge has been broken.

This invention relates to a gas-operated absorption refrigerating apparatus provided in a vehicle, for example, a recreational vehicle, which is connectible to a motor-driven generator, and having a heating cartridge for alternative operation by electricity, the electric circuit through the heating cartridge comprising a thermostatically controlled switch and a magnet coil arranged, when energized, to hold a contact in an electric circuit of a safety device for the gas supply and also an electric circuit through a control system for the gas burner closed, the control system acting in such a manner that the gas burner is automatically operated if the circuit of the heating cartridge is broken.

In order that the invention will be more clearly understood, it will now be disclosed in greater detail with reference to the accompanying drawings, in which:

The sole FIGURE comprises an electric heating cartridge 10 in a circuit 11, which by means of an outlet plug 12 is connected to a socket 13 in an electric mains supply circuit 14, and a heating cartridge 15 in a circuit 20 which is connected by a rectifier 17 to a generator 18. The latter also charges a battery 19 connected by means of a circuit 20 to a control system 21 for a gas burner 22. The latter is supplied with gas by means of a conduit 23. The gas burner is also provided with a safety device including a magnetic valve 24 having a coil connected by a wire 25 to a thermocouple 26 located adjacent to the burner flame. If the flame goes out, the valve 24 will be closed.

The circuit 11 through the heating cartridge 10 for the electrical supply from the mains includes a coil 27 which disconnects switches 28, 29, 30 in the other circuits.

The circuit 16, through the heating cartridge 15 for battery voltage, includes a coil 31 which disconnects switches 32, 33 in the circuit 20 and in the wire 25 of the safety device.

In each circuit 11, 16 and 20 a manually operated switch 34, 35, 36 is included, the switch 35 in the circuit 16 being connected to the ignition key of the engine of the vehicle.

According to the teachings of the present invention, a wire 38 is disposed in the circuit 16 with the heating cartridge 15 in parallel with the latter and connected to a thermostatically controlled switch 37. The wire 38 has a resistor 39 emitting heat to a thermoswitch 40 in a wire 41 which, when the switch 40 is on, establishes connection of two points 42 and 43 in the circuit 20 to one another. Positioned in the wire 41 and parallel to the thermoswitch 40 a manually operable and automatically reverting switch 44 is also provided.

The switch 37 is connected to a thermostat 45, and through impulse conduit 46 to a sensor 47 disposed in a suitable location in the refrigerator cabinet. This thermostat 45 also controls a switch 48 in the circuit 11, as well as a gas valve 49.

When the vehicle engine is operating there is normally no connection to the electric mains supply and the cartridge 10 is inactive. In addition, the coil 27 is inactive and the switch 28 in the circuit 16 is connected. The switch 35, which can be a switch connected to the ignition key of the vehicle, is switched on, and the generator 18 commences to operate. When the trailer or motor home is moved into a filling station, the ignition and hence the switch 35 are switched off, and the operation of the generator is discontinued. The heating cartridge 15 becomes inactive and the control circuit 20 starts operating and current is supplied from the battery 19, However, in accordance with the invention, the circuit 20 is broken between the points 42 and 43 and is replaced by the wire 41 with the thermoswitch 40 which during the previous operation has been heated by the resistor 39. As long as the resistor 39 continues to be warm, the circuit 20 will not be closed. The resistor 39 can be made of a specially selected mass of material, and have an insulation, which may include the switch 40, so as to cause a suitable delay of the connection of the switch 40. For example the delay can be such that the control system 21 does not enter into operation to control ignition attempts of the burner 22 until about 15 minutes after the generator has stopped operating. This time period should be sufficient for filling the vehicle in the station.

On accasional stops, for example engine failure or other short stops, the proposed arrangement acts in such a manner that no immediate attempts at starting the gas operation are made, which is only an advantage. For such short interruptions of the supply of electric energy to the refrigerating apparatus, the supply of energy from another source is not required.

The arrangement illustrated in the sole FIGURE and described above is an example of the principle of the solution to the above problem in order to achieve delayed starting of the gas operation when the supply of electric energy is discontinued. There are, however, several possibilities of applying this principle in practice. For example, when the vehicle has a large engine and the filling time is long, the thermoswitch 40 can be connected to a part which is heated by the vehicle engine when running and which, when the engine stops, cools after a somewhat longer time than mentioned above.

The manually operated switch 44 in the wire 41 is intended to be used, for example, when the gas burner is to supply heat to the refrigerating apparatus when the trailer is in a parking place, and it is not desired to wait for the car engine to cool before heat is again supplied to the refrigerating apparatus. In such case there is no reason for preventing immediate start of operation of the gas burner. The switch 44 is kept connected during ignition of the gas flame at the burner 22. As soon as the resistor 39, or the heated part concerned, has cooled, the circuit 20 becomes again conductive and the control system 21 starts operating.

The problem can also be solved by providing a switch and a component in the control circuit 20, which component can be charged with energy while the engine is running, and when the engine stops running is slowly discharged, and after discharging, acts on the switch.

It is within the scope of the present invention to provide another embodiment thereof in which the control circuit 20 can be equipped with a switch and a member whose energy is discharged during operation of the engine, and after the engine has stopped, is slowly charged in order to act on the switch.

What is claimed is:

1. A control system for a gas-operated absorption refrigerator provided in a vehicle, such as a trailer, motor home or the like, said refrigerator being connected to a motor-driven generator and having a heating cartridge and means for alternate operation by electricity or gas comprising: a first electric circuit having said heating cartridge therein and including a thermostatically controlled switch and a magnetic coil, a second electric circuit having a safety device for said gas supply and being provided with a contact wherein when said magnetic coil is energized said coil holds said contact in said second electric circuit in an open condition, and an electric control circuit having a control system therein, said safety device for the gas supply in said second electric circuit maintaining said gas burner operative when in a closed condition, said control system functioning in such a manner that the gas burner is automatically operated if the first circuit with the heating cartridge is opened, and means for delayed closing of said electric control circuit through said control system when said first circuit through said heating cartridge has been opened.

2. A control system for a gas-operated absorption refrigerator as claimed in claim 1 wherein said electric control circuit further comprises a thermoswitch provided with a resistor for heating said switch and dispoed in said first electric circuit parallel to said heating cartridge and said thermostatically controlled switch.

3. A control system for a gas-operated absorption refrigerator as claimed in claim 1 further comprising a thermoswitch in said electric control circuit mounted adjacent to a part that is heated when said vehicle motor is operative and cooled when said motor is inoperative.

4. A control system for a gas-operated absorption refrigerator as claimed in claim 1 wherein said electric control circuit includes a switch and a component which is charged with energy when said vehicle motor is operative, and is slowly discharged, and after discharging acts on said switch to close said second electric circuit.

5. A control system for a gas-operated absorption refrigerator as claimed in claim 1 wherein said electric control system has a switch, and a member whose energy is discharged while said vehicle engine is operating, and when operation ceases is slowly charged to act on said switch.

* * * * *